United States Patent [19]

Jezbera

[11] 4,426,930

[45] Jan. 24, 1984

[54] COMPACT BAND PRINTER

[75] Inventor: Val K. Jezbera, Thousands Oaks, Calif.

[73] Assignee: Dataproducts Corporation, Woodland Hills, Calif.

[21] Appl. No.: 327,758

[22] Filed: Dec. 7, 1981

[51] Int. Cl.[3] ..... B41J 1/20

[52] U.S. Cl. ..... 101/93.14; 101/111

[58] Field of Search ..... 101/93.14, 111, 93.34

[56] References Cited

U.S. PATENT DOCUMENTS

| | | | |
|---|---|---|---|
| 3,499,382 | 3/1970 | Potter et al. | 101/93.14 |
| 3,628,453 | 12/1971 | Jackson et al. | 101/111 |
| 3,741,110 | 6/1973 | Bossi | 101/93.14 |
| 3,845,711 | 11/1974 | Helms | 101/93.14 X |
| 4,210,076 | 7/1980 | Yamamoto et al. | 101/93.14 X |
| 4,275,653 | 6/1981 | Bolcavage et al. | 101/93.14 |
| 4,301,725 | 11/1981 | Hiki et al. | 101/93.14 |

*Primary Examiner*—Edward M. Coven

*Attorney, Agent, or Firm*—Spensley, Horn, Jubas & Lubitz

[57] ABSTRACT

A compact band printer system incorporating an inverted character band and a hammer bank assembly in which the hammer bank frame serves as the main support frame for the printer. Ribbon, band pulley and tractor drive assemblies are all supported by the hammer bank frame. A platen is secured to the frame and serves to increase the rigidity of the structure.

16 Claims, 6 Drawing Figures

COMPACT BAND PRINTER

BACKGROUND OF THE INVENTION

1. Field of the Invention

This invention relates to high speed impact printers of the type generally employed in data processing systems. Typically, such systems include a hammer bank assembly having a plurality of flat bodied print hammers arranged in a row and interleaved with a plurality of magnets. In particular, the invention is directed to a printer assembly of the type which utilizes a moving band which contains a raised type font. The band moves along an impact line and when a particular character is positioned in a desired print position, the hammer for that position is energized to impact against the band so as to cause the character to be printed.

2. Prior Art

Examples of hammer bank assemblies useable in band printers are shown in U.S. Pat. Nos. 3,643,595 to Helms and 3,983,806 to Ishi. Both of these patents disclose a hammer bank assembly having a plurality of print hammers comprised of a flat coil body section carried by a pair of crossed spring wires and including an impact tip. The hammers are arranged in a spaced relationship along the length of a frame, and are interleaved with a plurality of magnets which are also attached to the frame.

In typical prior art band printer assemblies, the moving character band is formed into a loop and carried by a pair of pulleys. The loop is spaced in front of the hammer bank assembly and a ribbon is passed between the moving character band and the hammer bank. A platen is located within the character band loop. A print medium such as paper is passed between the hammer bank and the ribbon and the hammers are impacted against the platen in a controlled fashion in order to accomplish printing. An example of such a prior art configuration is shown in FIG. 1.

The prior art configuration described above has several disadvantages associated with it. Initially, the hammer bank and character band must be accurately positioned with respect to one another. In order to accomplish this, the two components are generally mounted upon a cast main frame which must be very accurately machined. These main frames are also generally used to support a ribbon cassette assembly and a paper tractor drive assembly. The frame makes up a significant portion of the cost of mechanical items in a printer. In addition, various frames must be separately designed and fabricated for use with different sized hammer bank assemblies. This increases the cost of manufacture of a family of printer assemblies.

In addition to the cost and manufacturing difficulty involved when using a cast and machined main frame, the prior art configuration presents significant accessibility problems. Because the hammer bank assembly is located on one side of the print medium and the character band assembly on the other, access to the assembly for loading and unloading of the print medium is severely restricted. Paper loading is generally done from below the assembly near the middle of the device. Because of the relative inaccessibility to the paper feed path, the hammer bank assembly is typically mounted upon a movable subframe which is mounted upon the main fame. The subframe is moved away from the character band during loading of paper into the printer. This further increases the complexity and cost of the assembly.

Several prior art printer assemblies position the hammer bank assembly within the loop formed by the moving character band. Assemblies of this type are shown in U.S. Pat. Nos. 3,585,927 to Burns et al., 3,719,139 to Niccolai and 3,741,110 to Bossi. In all of these printers, the type font is located on the outside of the moving band and the hammers are impacted to force the type characters against a platen located behind the hammer bank and character band assemblies. Although these printers may provide some reduction in the size of the assembly, they provide little or no improvement in ease of loading or visibility of the print medium.

SUMMARY OF THE INVENTION

It is an object of the present invention to provide a low cost, compact character band printer which does not require an expensive cast and machined main frame. It is a further object of the invention to provide a band printer in which paper loading is greatly simplified. Yet another object of the invention is to provide a printer having improved accesability for maintenance. Another object of the invention is to provide a printer assembly in which modular components are utilized, thereby facilitating the manufacture of various size printers using many identical components. It is another object of the invention to eliminate the need for locating the hammer bank assembly on a movable subframe. Another object of the invention is to increase the ease of viewing the matter which is being printed in the printer.

These and other objects are achieved by providing a system in which the frame of the hammer bank assembly is utilized as the main frame for the entire printer assembly. The major sub-assemblies of the printer are seciured to the hammer bank frame rather than to a separate main frame. The platen is secured to the hammer bank frame so as to form an extremely rigid structure.

The invention employs an inverted character band in which the characters are positioned to the inside of the looped band. The hammer bank assembly is located within the loop and the platen is positioned on the outside of the loop. A ribbon passes between the character band and the hammers and a print medium such as paper is drawn between the hammers and ribbon. Printing is accomplished by impacting the hammers against the paper, forcing the paper against the ribbon and character band and causing the character band to contact the platen. The ribbon is supplied from a location toward the hammer bank assembly. The platen is the only structural element which is located in front of the paper. Thus, accessibility is greatly simplified and the visibility of the printed matter is significantly increased.

BRIEF DESCRIPTION OF THE DRAWINGS

The invention will be described with reference to the accompanying drawings wherein.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention is best defined by the appended claims.

Figure 1:
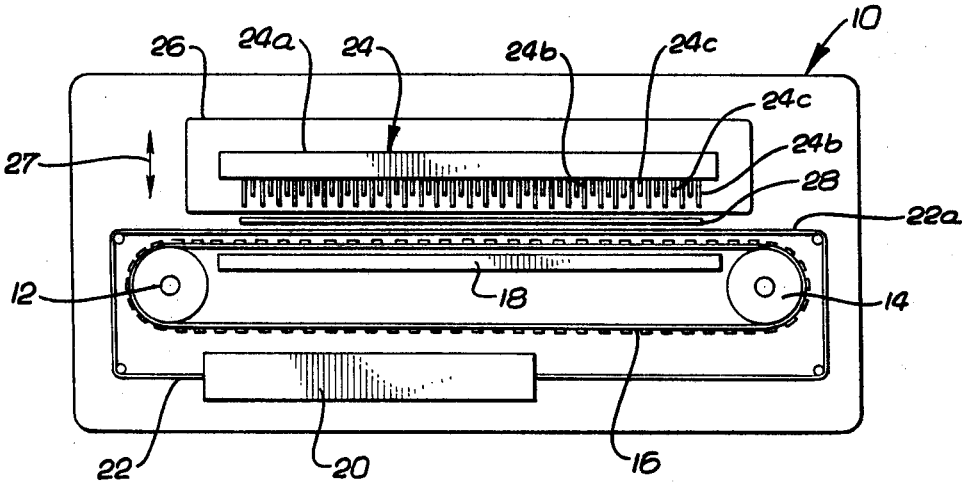
FIG. 1. PRIOR ART
FIG. 1 is a diagrammatic top plan view showing a prior art printer configuration.
Figure 2:
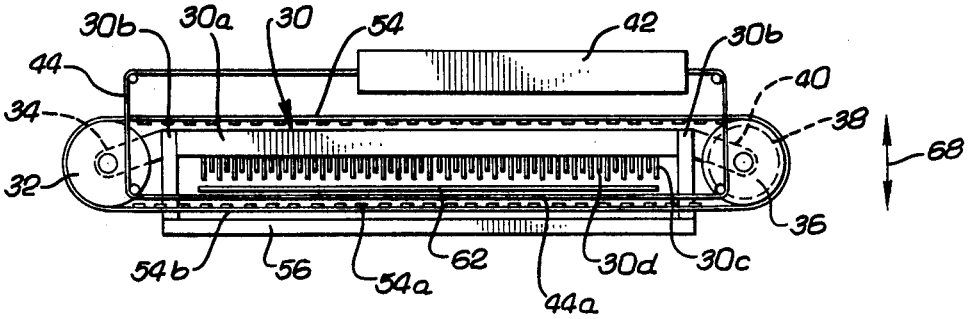
FIG. 2 is a diagrammatic top plan view of the printer configuration of the present invention.

FIG. 1 shows a prior art band printer configuration in which the major components of the printer are all mounted upon a cast and machined main frame 10. A pair of band pulleys 12 and 14 are rotatably secured to the main frame 10, with one of the pulleys being driven by means of a motor (not shown). A character band 16 is looped around the pulleys 12 and 14, with the raised print characters of the band being positioned toward the outside of the loop. A platen 18 is secured to the main frame 10 within the loop and adjacent to the band 16.

A ribbon cassette 20 is carried in the main frame in front of the character band 16. The ribbon cassette carries a ribbon 22 which is looped around the character band 16 so as to include a portion **22*a* which runs parallel and adjacent to the character band 14 on the side opposite the platen 18**.

A hammer bank assembly 24 which includes a frame **24*a*, print hammers 24*b* and interleaved magnets 24*c* is mounted upon a subframe 26. The subframe is in turn moveably mounted (in the direction shown by arrow 27) onto the main frame 10. The hammer bank assembly is positioned so that it is parallel and adjacent to the ribbon portion 22*a*, character band 16 and platen 18**.

A print medium such as paper 28 passes between the hammer bank assembly and the ribbon portion **22*a*. As can be seen in FIG. 1, accessibility to the paper 28 is relatively limited, since the hammer bank 24 and the subframe 26 are located to the rear of the paper and the character band assembly, platen and ribbon assembly are located in front of the paper. In order to facilitate loading of the paper, therefore, the hammer bank is mounted on the subframe 26**, which is moved away from the ribbon during loading.

Referring now to FIGS. 2–5, the printer configuration of the present invention will be described. As can be seen most clearly in FIG. 2, the invention includes a hammer bank assembly comprised of an elongated frame 30 including a central portion **30*a* and a pair of end or adapter plates 30*b*, print hammers 30*c* and interleaved magnets 30*d*. A band pulley 32 is secured to one end of the frame by means of a frame extension 34 attached to an adapter plate 30*b*. A second pulley 36 is attached to a motor 38 (FIG. 3), which is in turn attached to an extension 40 attached to the adapter plate 30*b*** at the opposite end of the frame.

Figure 3:
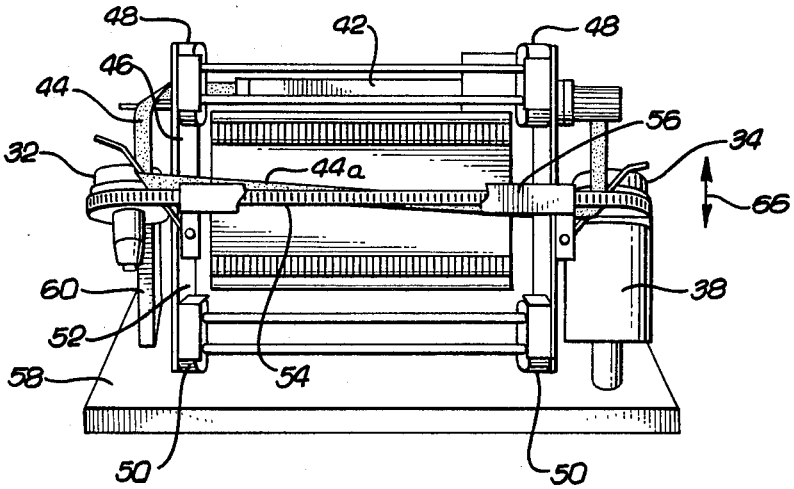
FIG. 3 is a front perspective view of the present invention.
Figure 4:
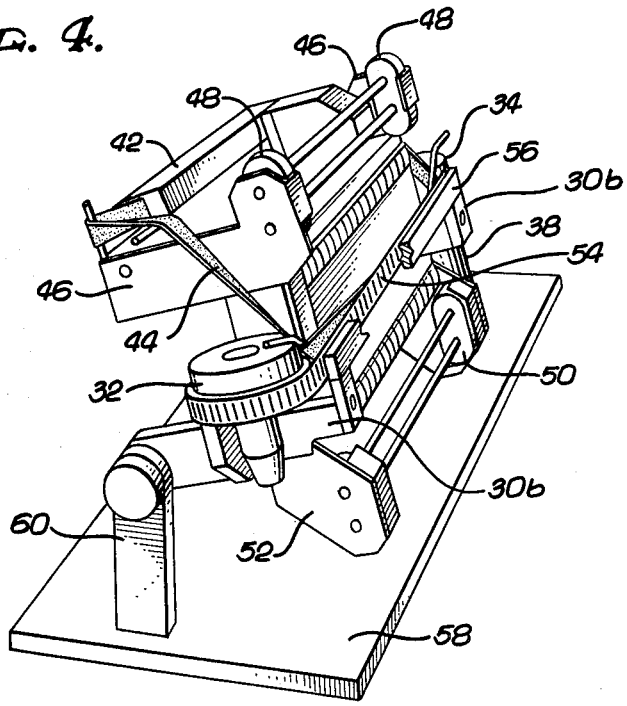
FIG. 4 is a side perspective view of the present invention.

A ribbon cassette 42 is located behind the hammer bank assembly and carries a ribbon 44 which is looped around the hammer bank so as to include a section **44*a* which extends in front of the hammers. The ribbon cassette 42 is attached to the adapter plates 30*b* by means of brackets 46 as shown in FIGS. 3 and 4. In addition, an upper tractor drive assembly 48 is attached to the brackets 46. A lower tractor drive assembly 50 is secured to the end plates 30*b* by mans of brackets 52**.

A stainless steel character band 54 is looped around the pulleys 32 and 36 and surrounds the hammer bank assembly. The character band is inverted as compared to prior art bands, i.e., the type characters **54*a* face to the inside of the loop. Interference between the type characters and the pulleys is avoided by providing cushioned surfaces on the pulleys (not shown). The location of the portion 54*b* of the character band in front of the hammer bank assembly is such that the ribbon portion 44*a* is located between the hammer bank and the character band. A platen 56 is secured to the adapter plates 30*b* and is positioned in front of the character band 54. As can be seen in FIG. 4, the adapter plates 30*b* include portions which extend forward from the hammer bank assembly beyond the character band in order to provide a mounting location for the platen 56. As shown in FIGS. 3 and 4, the entire printer assembly may be supported on a base 58 by means of legs 60 secured to the adapter plates 30*b***.

In operation, paper 62 is fed between the hammer bank assembly 30 and the ribbon portion **44*a*. In printing, a hammer impacts against the paper, causing it to contact the ribbon and force it against a character on the band 54, with the motion of the hammer being stopped by the platen 56. Because of the inverted configuration of the band, the printing will be accomplished in a forward facing direction. As can be seen in the figures, the only structural element of the printer which is in front of the paper is the platen 56**. Both the ribbon and band pulley assemblies are located either to the side or rear of the hammer bank assembly. This structure greatly simplifies paper loading, since there are very few components located in front of the paper path to interfere with the loading procedure. In addition, the visibility of the matter being printed is enhanced due to the lack of interfering elements.

In addition to the improvement in ease of paper loading, the structure of the present invention is significantly simpler than prior art configurations. Instead of employing a separate main frame to support all of the sub-assemblies of the printer, the hammer bank frame 30 also serves as the main structural frame for the entire printer assembly. This design significantly reduces the cost of the assembly. In addition, the securing of the platen 56 to the hammer bank frame provides a rectangular shaped frame which is extremely rigid. The hammer bank frame provides rigidity in the vertical direction (indicated by an arrow 66 in FIG. 3), while the combination of the platen and hammer bank frame provides rigidity in the horizontal direction (indicated by an arrow 68 in FIG. 2).

The compactness of the printer assembly shown in FIGS. 2–5 make it feasible to produce a table top printer in which the electronics used to drive the hammers are located in a position remote from the printer assembly. This is in contrast to prior art printers, which are generally carried in a separate free standing housing.

The present design lends itself to modular construction by providing a separate central frame section **30*a* and individual adapter plates 30*b*. Different sized hammer banks (e.g., assemblies utilizing 40, 60, or 132 hammers) are made by providing various length central portions 30*a* and platens 56. The adapter plates 30*b***, ribbon assembly and band pulley assembly are identical for any different size printer, thus resulting in increased ease in manufacture. The modular design obviates the need for custom manufacturing of various size main frames.

Figure 5:
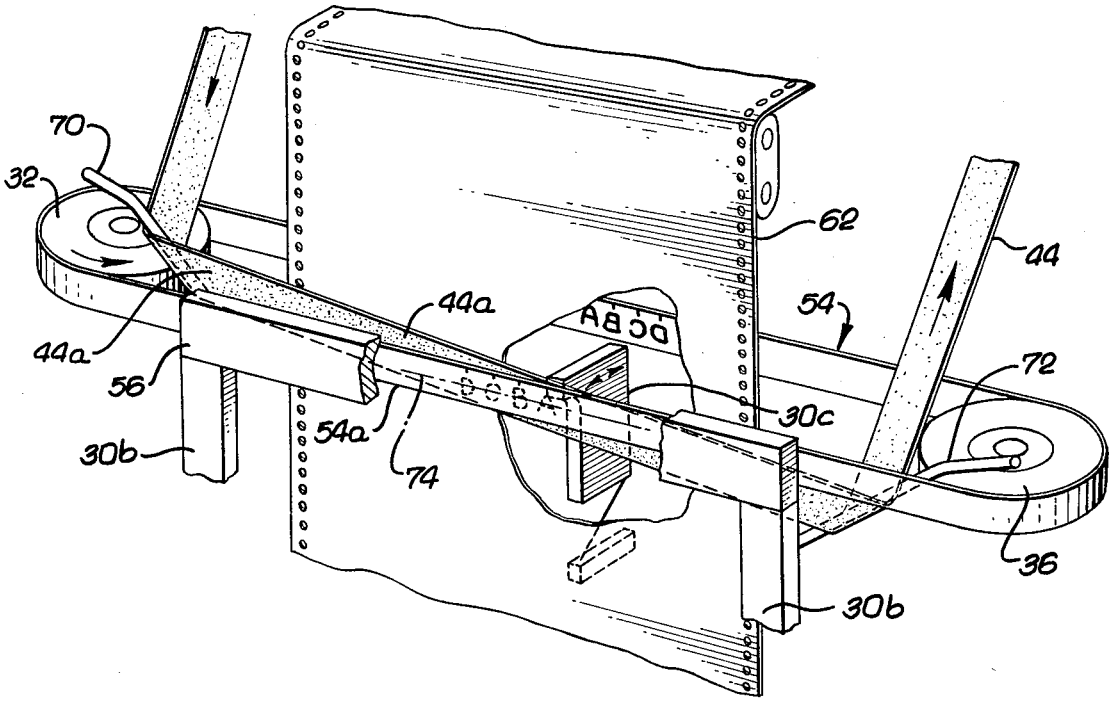
FIG. 5 is a perspective diagrammatic view showing details of the configuration of the present invention.

As shown in FIG. 5, the system is provided with a simple ribbon guide assembly which includes angled posts 70 and 72. The posts are positioned so that the ribbon portion 44*a* crosses the print line 74 of the printer at an angle so that the entire height of the ribbon is utilized.

Figure 6:
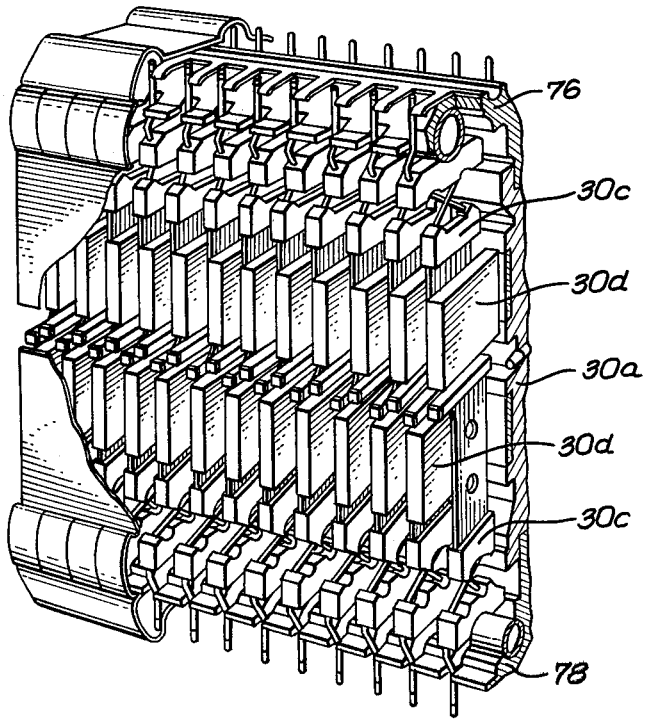
FIG. 6 is a perspective view of a portion of hammer bank assembly which may be used with the present invention.

Referring to FIG. 6, a detail of a portion of the hammer bank assembly utilized in the present invention is shown. This assembly is described in detail in U.S. patent application Ser. No. 65,766 filed Aug. 13, 1979 and assigned to the same assignee as the present invention. The central portion of the frame 30*a* is formed of an elongated piece of extruded aluminum, to which the magnets 30*d* are attached (e.g., by epoxy adhesive). Upper and lower banks of hammers 30*c* are connected to generally L-shaped shoe sections 76 and 78 which are attached to the top and bottom of the extruded frame. The upper and lower hammer bank assemblies are interleaved so that the hammers all impact on a common print line.

In summary, the present invention is directed to an improved structure for a band printer assembly which provides a compact, low cost, high accessibility printer. This is accomplished by utilizing an inverted character band and positioning the hammer bank assembly within the band. The ribbon and band pulley assemblies are located either to the side or rear of the hammer bank assembly and the only element which is in front of the assembly is the platen. The platen operates in conjunction with the hammer bank frame to provide an extremely rigid support frame for the assembly. By having the hammer bank frame provide the dual function of supporting the hammers and operating as the main support frame for the printer, both the size and cost of the system are reduced.

I claim:

1. A moving band printer assembly, comprising:

a base member;

an elongated hammer bank frame section secured to the base member;

a plurality of print hammers secured to the frame section along the length thereof, said print hammers for impacting along a common print line;

a character band including a portion extending along the print line adjacent to the hammers, wherein the character band moves along the print line to position characters adjacent each print hammer;

an inked ribbon extending along the print line between the hammers and the character band; and a platen located adjacent the character band on the side of the band opposite the print hammers, wherein each end of said platen is securely attached to the frame section to form a box shaped structure with the frame section and thereby increase the structural rigidity of the assembly.

2. The band printer assembly of claim 1 including first and second band pulleys located at opposite ends of the frame section, wherein the character band is looped around the pulleys and wherein the hammers and the frame section are located within the loop formed by the character band, said configuration facilitating simplified loading of a printing medium between the hammers and the platen and providing for a more compact structure.

3. The band printer assembly of claim 2 wherein the ribbon is in the form of a loop and further including a ribbon cassette for carrying a portion of the ribbon loop, wherein said cassette is located on the side of the band opposite the platen and to the rear of the hammer bank frame section so that the ribbon loops around the frame section to thereby further facilitate loading of the print medium.

4. The band printer assembly of claim 2 including first and second arm sections secured to the frame section, wherein one of the pulleys is supported by one of the arm sections and further including a pulley drive motor attached to the other arm section, wherein the other pulley is coupled to the drive motor.

5. The band printer assembly of claim 2 including a tractor drive assembly secured to the frame section, said tractor drive assembly for transporting a print medium between the platen and hammers.

6. A band printer assembly, comprising:

a base member;

an elongated frame section;

a plurality of print hammers and magnets secured along the length of the frame section in an interleaved fashion, wherein the hammers are arranged to impact along a common print line;

first and second band pulleys, one coupled to each end of the frame section;

a character band carried by the pulleys looped around the frame section, hammers and magnets, wherein the character band is movable along the print line of the hammers;

a platen secured to the frame section; and an inked ribbon assembly including a ribbon having a portion which passes between the platen and hammers and a ribbon cassette for carrying the ribbon, wherein the ribbon cassette is supported by the frame section;

wherein the frame section is the main support frame for the printer assembly.

7. The printer assembly of claim 6 including a tractor drive assembly secured to the frame section.

8. A band printer assembly, comprising:

a hammer bank assembly, said hammer bank assembly including an elongated frame section, a plurality of generally planar print hammers secured to the frame section and arranged to impact along a common print line, and a plurality of magnets secured to the frame section and interleaved with the hammers;

first and second end plates secured to opposite ends of the frame section; and at least one printer subassembly secured to the endplates, wherein the frame section functions as the main structural support for said at least one printer subassembly, wherein a first subassembly comprises a character band including a portion extending along the print line adjacent to the print line and first and second band pulleys located at opposite ends of the frame section.

9. The printer assembly of claim 8, wherein the character band is looped around the frame section and hammers and is positioned adjacent the print line so that the loading and unloading of the print medium is facilitated.

10. The printer assembly of claim 8 wherein the subassemblies include a ribbon assembly.

11. The printer assembly of claim 8 wherein the subassemblies include a tractor drive assembly for transporting a print medium.

12. The printer assembly of claim 8 including a platen secured to the end plates and located adjacent the hammers along the print line, wherein the platen, frame section and end plates form a rigid box shaped structural support for the printer assembly.

13. A compact band printer assembly, comprising:

a hammer bank assembly including an elongated frame section and a plurality of print hammers and magnets secured to one side of the frame section in an interleaved fashion, wherein the hammers are arranged to impact along a common print line;

first and second band pulleys secured to opposite ends of the frame section;

a character band carried by the pulleys and looped around the hammer bank assembly, said character band including a plurality of print characters located on the inside of the loop, wherein the band is located so that the characters move along the common print line spaced from the hammers;

an inked ribbon which passes along the common print line between the character band and hammers, wherein said ribbon is supplied from a location toward the frame section; and a platen positioned along the print line on the side of the character band opposite the hammers, wherein said configuration facilitates simplified loading of a print medium such as paper into the printer assembly.

14. A modular band printer assembly, comprising:

a frame section including an elongated center portion and first and second end portions secured to opposite ends of the center portion;

a plurality of print hammers and magnets secured to the center portion in an interleaved fashion wherein the print hammers are arranged to impact along a common print line;

a band pulley secured to each of the end portions;

a band drive motor secured to one of the end portions and coupled to a pulley;

a character band looped around the pulleys, said character band surrounding the frame section and passing along the print line;

a ribbon assembly secured to the end portions, said ribbon assembly including a ribbon cassette supported on the side of the center portion opposite the hammers and a ribbon which extends from the ribbon cassette around the frame section and passes along the print line between the hammers and character band; and a platen secured to the end portions, said platen located along the print line to the outside of the character band;

wherein the frame section functions both as a hammer bank mounting element and the main printer support structure, and wherein the modular construction of the frame section enables various frame sizes to be provided by employing different length center portions.

15. The printer assembly of claim 14 wherein the center portion is extruded metal.

16. The printer of claim 14 wherein the end portions each include a forward protruding section which extends beyond the hammers and character band, wherein the platen is secured to the protruding sections, the combination of the frame section and platen forming a rigid box frame for the printer assembly.

* * * * *